US006361350B2

(12) United States Patent
Johnson et al.

(10) Patent No.: US 6,361,350 B2
(45) **Date of Patent: *Mar. 26, 2002**

(54) CARD CONNECTOR HAVING A GUIDE PORTION

(75) Inventors: Glenn W. Johnson, Webster; David J. Glogan, Rochester, both of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,698

(22) Filed: Nov. 12, 1998

(51) Int. Cl.[7] ..... H01R 13/64
(52) U.S. Cl. ..... 439/374
(58) Field of Search ..... 439/64, 374, 377

(56) References Cited

U.S. PATENT DOCUMENTS

| | | | | | |
|---|---|---|---|---|---|
| 3,966,290 | A | * | 6/1976 | Little | 439/374 |
| 5,016,107 | A | | 5/1991 | Sasson et al. | 358/209 |
| 5,161,996 | A | * | 11/1992 | Locati | 439/374 |
| 5,227,953 | A | * | 7/1993 | Lindberg | 439/374 |
| 5,297,966 | A | * | 3/1994 | Brennian, Jr. et al. | 439/64 |
| 5,305,182 | A | * | 4/1994 | Chen | 439/79 |
| 5,327,323 | A | | 7/1994 | Yeom et al. | 439/377 |
| 5,608,605 | A | | 3/1997 | Siow et al. | 361/684 |
| 5,663,867 | A | | 9/1997 | Honda et al. | 361/684 |
| 5,673,180 | A | | 9/1997 | Pernet | 361/756 |
| 5,697,805 | A | * | 12/1997 | Orstad et al. | 439/374 |

FOREIGN PATENT DOCUMENTS

JP 2-105984 * 4/1990

* cited by examiner

*Primary Examiner*—Neil Abrams
(74) *Attorney, Agent, or Firm*—Susan L. Parulski

(57) ABSTRACT

A card connector (30) having a guide portion (40) to ease loading/unloading of a memory card (14). The card connector (30) includes a substantially rectangular slot (38) defined by a top edge (32), a pair of side edges (34), and a bottom margin (36). The guide portion (40) is disposed adjacent the slot (38) and has a bottom wall (42) and a pair of side walls (44). A first tapered feature (50), disposed on the bottom wall (42), is directed from a leading edge (52) of the bottom wall (42) toward the bottom margin (36) of the slot (38). Each of the side walls (44) has a second tapered feature (60) directed from a leading edge (62) of the side wall (44) toward one of the pair of side edges of the slot (38). The guide portion (40) will prevent stubbing of the memory card (14) against edges of the card connector (30) slot (38) and may be retro-fit onto an existing card connector assembly.

3 Claims, 6 Drawing Sheets

CARD CONNECTOR HAVING A GUIDE PORTION

FIELD OF THE INVENTION

The present invention relates generally to a memory card compatible device such as an electronic imaging device, film scanner, or computer, which facilitates the interchange of information between systems simply by inserting and removing a memory card from a first system and transferring the memory card and the information on it to a second system. More particularly, the present invention relates to a card connector which facilitates insertion and removal of the memory card in the memory card compatible device.

BACKGROUND OF THE INVENTION

A digital imaging device is a device which uses an electronic sensor to capture an image either directly from an object or indirectly from a medium such as film; signal processing to represent the captured signal numerically; and some storage device to preserve the numerical image data. Known imaging devices use a removable storage device, such as an integrated circuit memory card, to store images. For example, U.S. Pat. No. 5,016,107 (Sasson et al), commonly assigned, describes an electronic still camera utilizing image compression and providing digital storage in a removable memory card having a static random access memory. In this camera, the integrated circuits in the removable memory card store image data and a directory for locating the data.

In a prior art electronic still photography system, shown in FIG. 1, a electronic camera 10 or a film scanner 12 includes a slot for receiving a removable memory card 14. Memory card 14 also interfaces with a memory card slot 15 in a host computer 16. Disposed within the memory card compatible devices (e.g., digital camera 10, film scanner 12, or host computer 16) is a card connector which removably receives memory card 14. FIG. 2 shows a prior art card connector 18 having a wall 20 defining a slot 22 for receiving memory card 14 therethrough. Card connectors are commercially available from vendors such as SanDisk and 3M.

When memory card 14 is inserted through slot 22 by a user, memory card 14 may abut or stub against the four edges 24,24',26,26' of slot 22, particularly if card connector 18 is disposed at a distance within the memory card compatible device and not visible to the user. Such stubbing may damage the memory card, rendering i t inoperable for its intended purpose.

U.S. Pat. No. 5,663,867 (Honda et al) describes guide paths for guiding the memory card to the card connector. However, such guide paths, as illustrated in FIG. 36 of Honda et al, are not suitable for consumer memory card compatible devices which are small in size, such as a hand-held electronic camera. Further, such guide paths reduce stubbing of the memory card along two sides of the slot, but do not reduce stubbing alone, the other two sides of the slot. In addition, such guide paths cannot be incorporated with prior-art card connectors, such as illustrated in FIG. 2.

Accordingly, a need continues to exist for a card connector having a guide member for guiding the memory card to the card connector which is suitable for small devices having limited interior space, reduces stubbing on all four side s of the card connector slot, and can be incorporated/retro-fit with existing, card connectors.

SUMMARY OF THE INVENTION

An object of the present invention is to provide a card connector having a guide member for guiding a memory card to the card connector.

Another object of the invention is to provide such a card connector which is suitable for devices having limited interior space.

Still another object of the invention is to provide such a card connector which reduces stubbing whereby none of the edges of the memory card will stub on the card connector slot.

Yet a further object of the invention is to provide such a card connector which can be incorporated with commercially available card connectors.

These objects are given only by way of illustrative example. Thus, other desirable objectives and advantages inherently achieved by the disclosed invention may occur or become apparent to those skilled in the art. The invention is defined by the appended claims.

According to one aspect of the invention, there is provided a card connector for removably receiving a memory card. The card connector includes a top edge, a pair of side edges, and a bottom margin defining a substantially rectangular slot for removably receiving the memory card. A guide portion is disposed adjacent the slot and has a bottom wall and a pair of side walls. The bottom wall includes a first tapered feature directed from a leading edge of the bottom wall toward the bottom margin of the slot, while each of the side walls has a second tapered feature directed from a leading edge of the side wall toward one of the pair of side edges of the slot.

According to another aspect of the invention, there is provided a card connector for removably receiving a memory card. The card connector includes a top edge, a pair of side edges, and a bottom margin defining a substantially rectangular slot for removably receiving the memory card. The card connector also includes a guide portion having a bottom wall and a pair of side walls. The bottom wall has at least one ramp directed from a leading edge of the bottom wall to the bottom margin of the slot. Each of the side walls has at least one ramp directed from a leading edge of the side wall to one of the pair of side edges of the slot, the leading edge of the bottom wall and the leading edges of the side walls defining an opening larger than the slot.

According to a further aspect of the invention, there is provided an apparatus wherein a memory card is loaded/unloaded therethrough. The apparatus comprises a case including an outer wall having an inlet through which the memory card is loaded/unloaded; a circuit board housed in the case; and a card connector. The card connector is affixed to a surface of the circuit board and adapted to removably receive the memory card and form an electrical connection between the memory card and the circuit board. The card connector has a top edge, a pair of side edges, and a bottom margin defining a substantially rectangular slot for removably receiving the memory card. The slot is continuous with the inlet, and is spaced from the inlet. The card connector further includes a guide portion disposed adjacent the slot and has a bottom wall and a pair of side walls. The bottom wall has a first tapered feature directed from a leading edge of the bottom wall toward the bottom margin of the slot, while each of the side walls has a second tapered feature directed from a leading edge of the side wall toward one of the pair of side edges of the slot.

According to a still further aspect of the invention, there is provided a guide member for use with a card connector having a top edge, a pair of side edges, and a bottom margin defining a substantially rectangular slot for removably receiving a memory card. The guide member comprises (i) a bottom wall having at least one ramp directed from a leading edge of the bottom wall to the bottom margin of the slot, and (ii) a pair of side walls, each of the side walls having at least one ramp directed from a leading edge of the side wall to one of the pair of side edges of the slot, the leading edge of the bottom wall and the leading edges of the side walls defining an opening larger than the slot.

The present invention provides a card connector having a guide member which is suitable for small devices having limited interior space. The card connector of the present invention reduces stubbing on all four sides of the card connector slot, and can be incorporated/retro-fit with existing card connectors.

BRIEF DESCRIPTION OF THE DRAWINGS

The foregoing and other objects, features, and advantages of the invention will be apparent from the following more particular description of the preferred embodiments of the invention, as illustrated in the accompanying drawings.

DETAILED DESCRIPTION OF THE INVENTION

Figure 1:
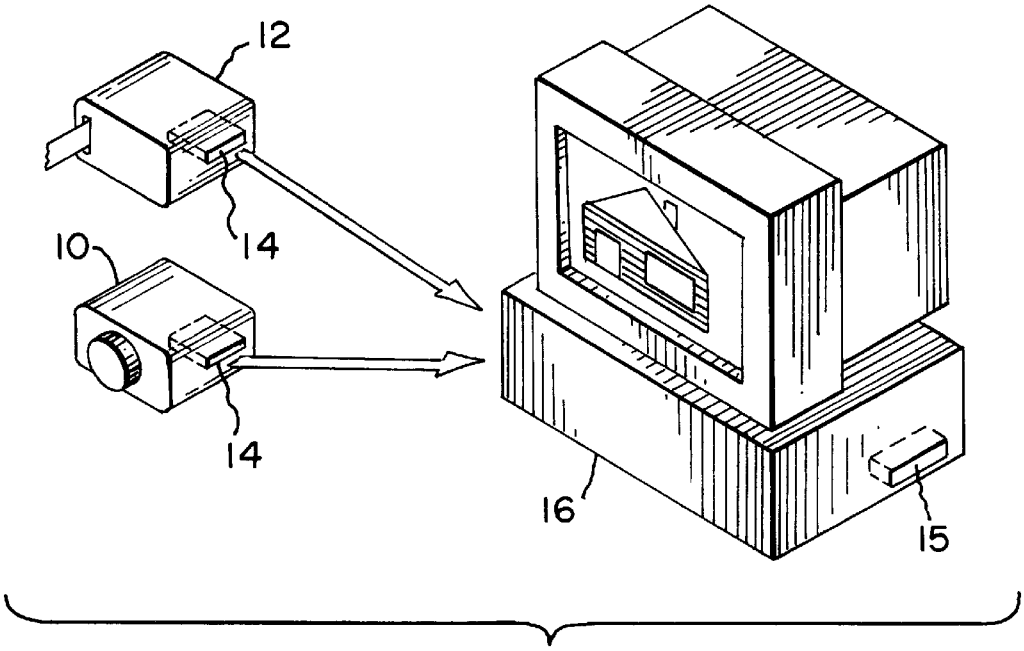
FIG. 1 (PRIOR ART)
FIG. 1 shows a prior art electronic still photography system.

The following is a detailed description of the preferred embodiments of the invention, reference being made to the drawings in which the same reference numerals identify the same elements of structure in each of the several figures.

Figure 3:
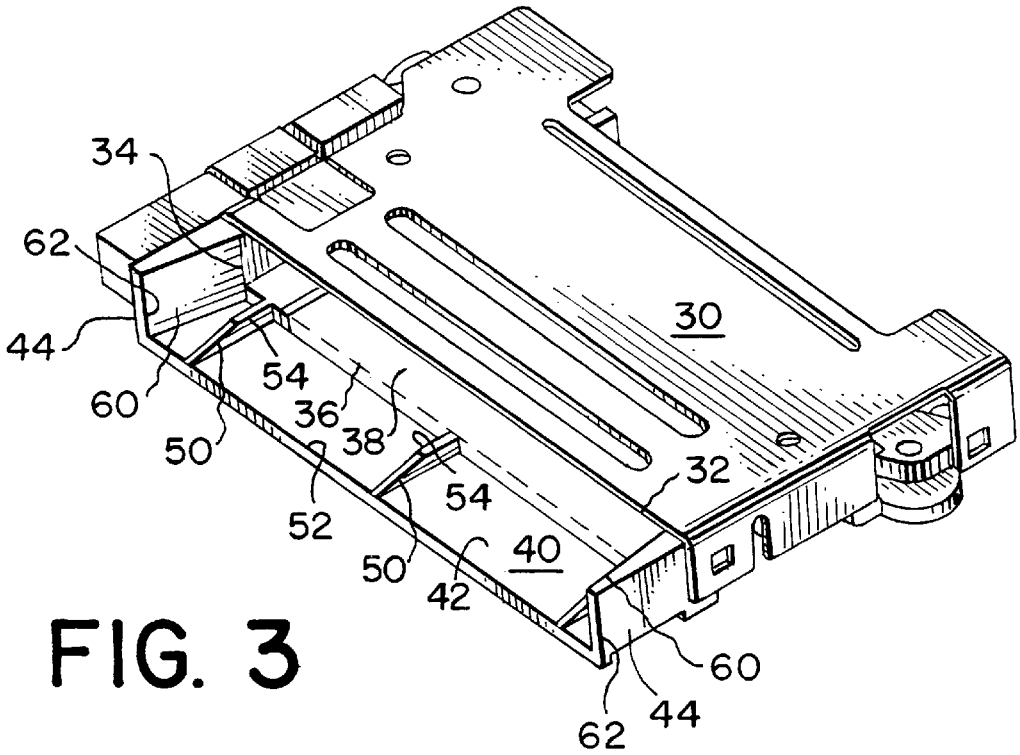
FIG. 3 shows a card connector in accordance with the present invention.

FIG. 3 illustrates a card connector 30 in accordance with the present invention. Card connector 30 includes a top edge 32, a pair of side edges 34, and a bottom margin 36 (shown by a dashed line) defining a substantially rectangular slot 38 for removably receiving memory card 14. Memory cards 14 are known to those skilled in the art. For example, memory card 14 can include memory cards adapted to the PCMCIA card interface standard, such as described in the *PC Card Standard, Release* 2.0, published by the Personal Computer Memory Card International Association, Sunnyvale, Calf., September, 1991. Memory card 14 can also be adapted to the Compact Flash interface standard, such as described in the *Compactflash Specification Version* 1.3, published by the CompactFlash Association, Palo Alto, Calif., Aug. 5, 1998. Manufacturers of such memory cards include SanDisk and LEXAR.

Card connector 30 further includes a guide portion 40 disposed adjacent slot 38. Guide portion 40 has a bottom wall 42 and a pair of side walls 44. Bottom wall 42 has an at least one first tapered feature 50 directed from a leading edge of the bottom wall 52 toward bottom margin 36 of the slot. Each of side walls 44 has a second tapered feature 60 directed from a leading edge 62 of side wall 44 toward one of the pair of side edges of slot 38. Guide portion 40 directs the memory card into the card connector, thus, leading edge 52 of bottom wall 42 and leading edges 62 of side walls 44 define an opening larger than slot 38.

Figure 4A:
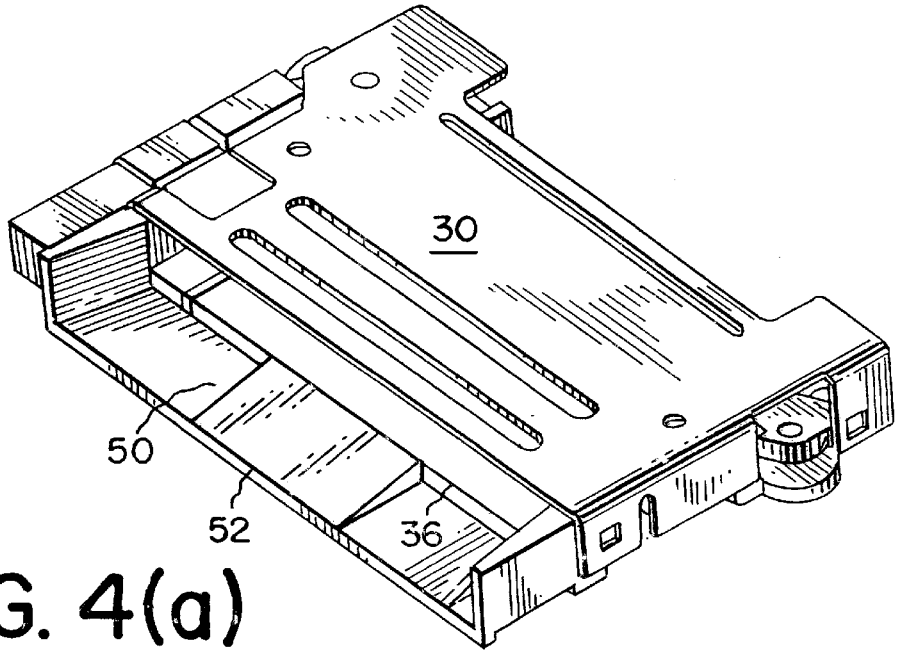
FIGS. 4(*a*) and 4(*b*) show alternate configurations for a first tapered feature of a guide portion of the card connector in accordance with the present invention.
Figure 4B:
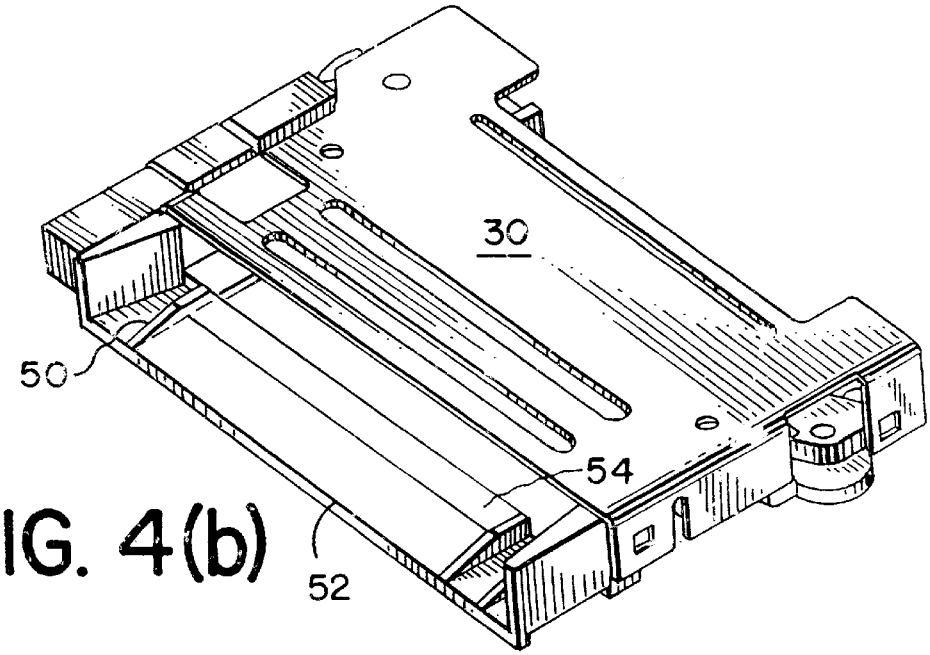

FIG. 3 illustrates first tapered feature 50 as a plurality of ribs. As illustrated, bottom wall 42 further includes a planar feature 54 disposed intermediate first tapered feature 50 and bottom margin 36 of slot 38. Planar feature 54 is dimensioned so as to be contiguous with first tapered feature 50 and bottom margin 36 of slot 38. Those skilled in the art will recognize that first tapered feature 50 may have other configurations. For example, FIG. 4(*a*) illustrates first tapered feature 50 as a singular ramp or wedge shape directed from leading edge 52 and abutting bottom margin 36. FIG. 4(*b*) illustrates another example wherein first tapered feature 50 is shown as a singular ramp, inclined plane, or wedge shape is combined with the planar feature disposed intermediate the first tapered feature and the bottom margin of the slot. The planar feature is contiguous with the first tapered feature and the bottom margin of the slot.

Referring again to FIG. 3, second tapered feature 60 is shown as a singular ramp or wedge shape directed from leading edge 62 and abuts side edge 34 of slot 38. Those skilled in the art will recognize that second tapered feature 60 can be configured as a plurality of ribs and may be combined with a planar feature as described above with regard to first tapered feature 50. If the second tapered feature is combined with the planar feature disposed intermediate the second tapered feature and the side edge of the slot, the planar feature would be contiguous with the second tapered feature and the side edge of the slot.

The dimension of first and second tapered features 50,60 is dependent on the configuration of the card connector, and also dependent on the dimensions of the memory card compatible device in which the card connector is disposed. More particularly, the dimension may be dependent on the dimension of bottom wall 42 and bottom margin 36.

Card connector 30 may be comprised of more than one material, and may include metals and polymers. However, guide portion 40 is preferably comprised of a polymer, such as one that can be injection molded.

Figure 5:
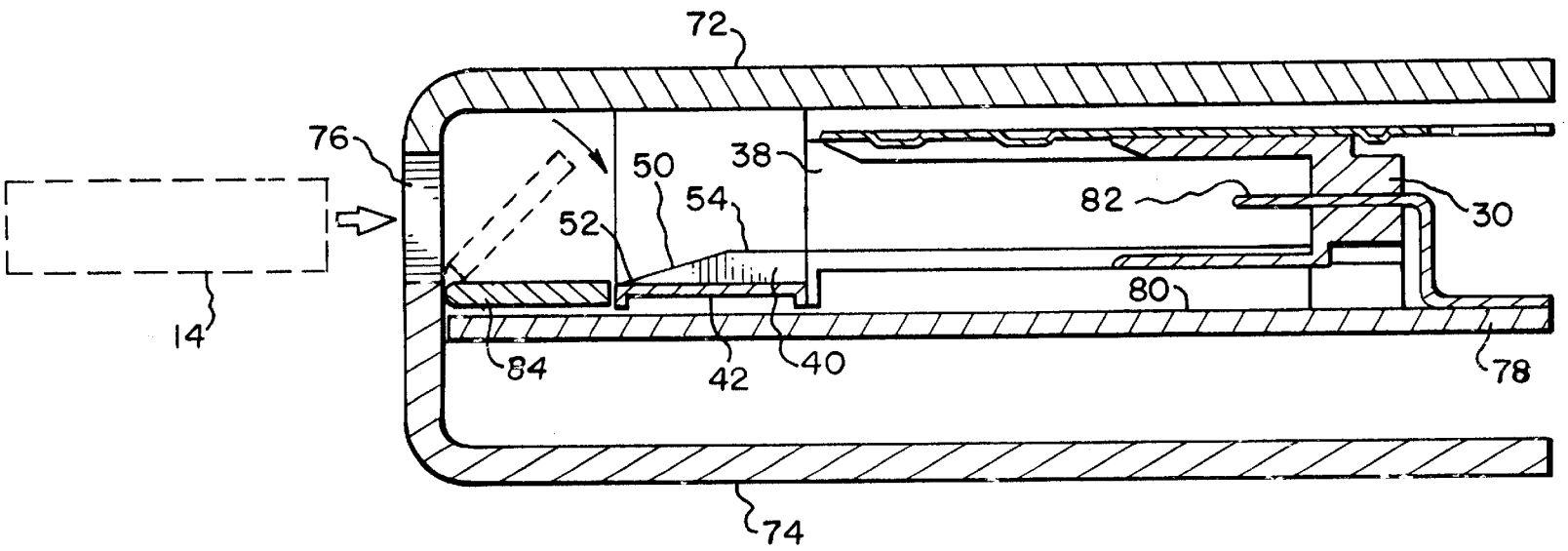
FIG. 5 shows a cross-sectional view of a first embodiment of a memory card compatible device having a card connector in accordance with the present invention.

FIG. 5 illustrates a memory card compatible device wherein a memory card is loaded/unloaded therethrough. The device includes a first portion 72 and a second portion 74 defining an inlet 76 through which memory card 14 is loaded/unloaded. A circuit board 78 is housed within the device. Card connector 30 is mounted/affixed to a surface 80 of circuit board 78, and bottom wall 42 of guide portion 40 is adjacent surface 80. As described above, card connector 30 is adapted to removably receive memory card 14 and form an electrical connection between memory card 14 and circuit board 78. Card connector 30 may include pin terminals 82 to detachably connect to terminal portions (not shown) on memory card 14. To ease loading of the memory card, slot 38 of card connector 30 is continuous with inlet 76. Guide portion 40 of card connector 30 is disposed adjacent slot 38. Guide portion 40 includes first tapered feature 50 and second tapered feature 60 (not shown in FIG. 5). FIG. 5 illustrates first tapered feature 50 as a ramp combined with planar feature 54 disposed intermediate the first tapered feature and the bottom margin of the slot.

Slot 38 is spaced from inlet 76, thus slot 38 may not be visible from outside of the device. Thus, guide portion 40 eases loading/insertion of memory card 14 into slot 38 without stubbing against the edges of the slot. Note that with the positioning of card connector 30 on circuit board 78, the dimension from surface 80 of circuit board 78 to margin 36 of slot 38 is minimal. As such, the length dimension of guide portion 40 is generally greater than the height dimension. If desired, leading edge 52 of bottom wall 42 may be disposed adjacent inlet 76. However, if the consumer memory card compatible device includes a pivotable door 84 covering inlet 76, leading edge 52 will need to be spaced accordingly from inlet 76 to allow insertion of the memory card. As such, the dimensions of guide portion 40 may be varied to permit its incorporation into consumer memory card compatible devices which are small in size.

Figure 6:
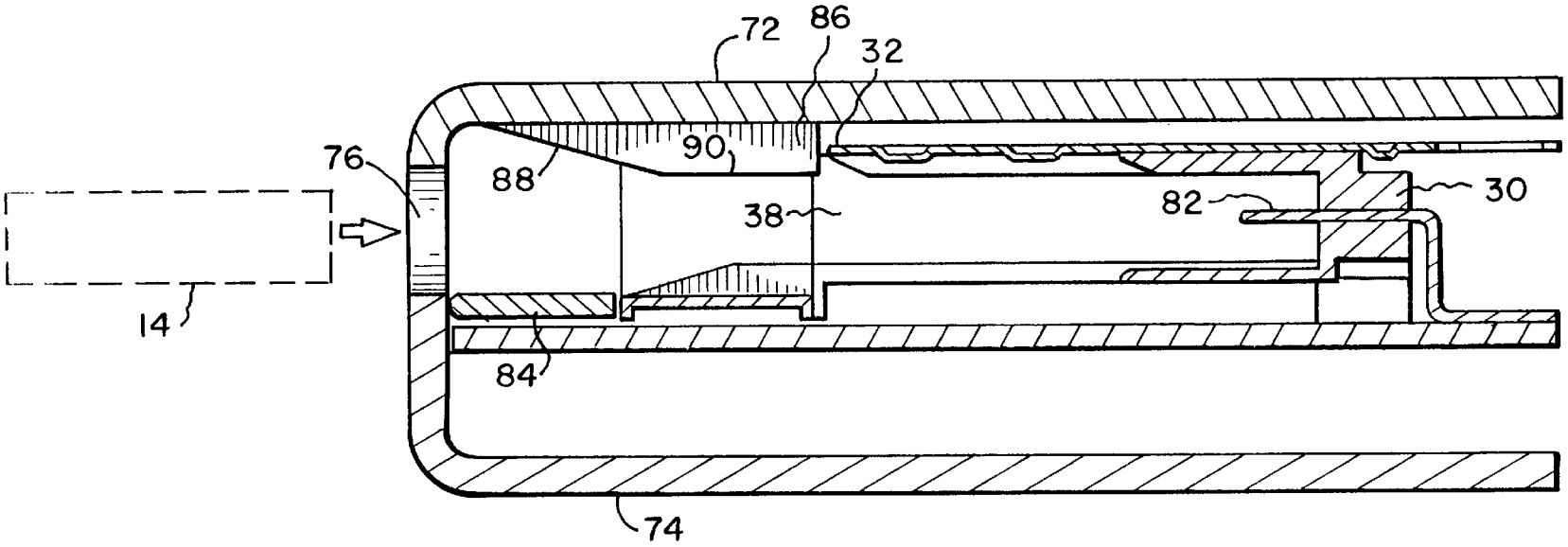
FIG. 6 shows a cross-sectional view of a second embodiment of a memory card compatible device having a card connector in accordance with the present invention.

FIG. 6 illustrates another embodiment of a memory card compatible device wherein first portion 72 further comprises a guide portion 86 including a third tapered feature 88 directed from inlet 76 toward slot 38. Third tapered feature 88 provides anti-stubbing for memory card 14 against top edge 32 of slot 38. As described above with regard to first tapered feature 50, third tapered feature 88 may be configured as a plurality of ribs, a ramp, or as a single angled wedge. Also, as illustrated in FIG. 6, guide portion 86 may further include a planar feature 90 disposed intermediate third tapered feature 88 and top edge 32 of slot 38. Planar feature 90 is dimensioned so as to be contiguous with third tapered feature 88.

Figure 2:
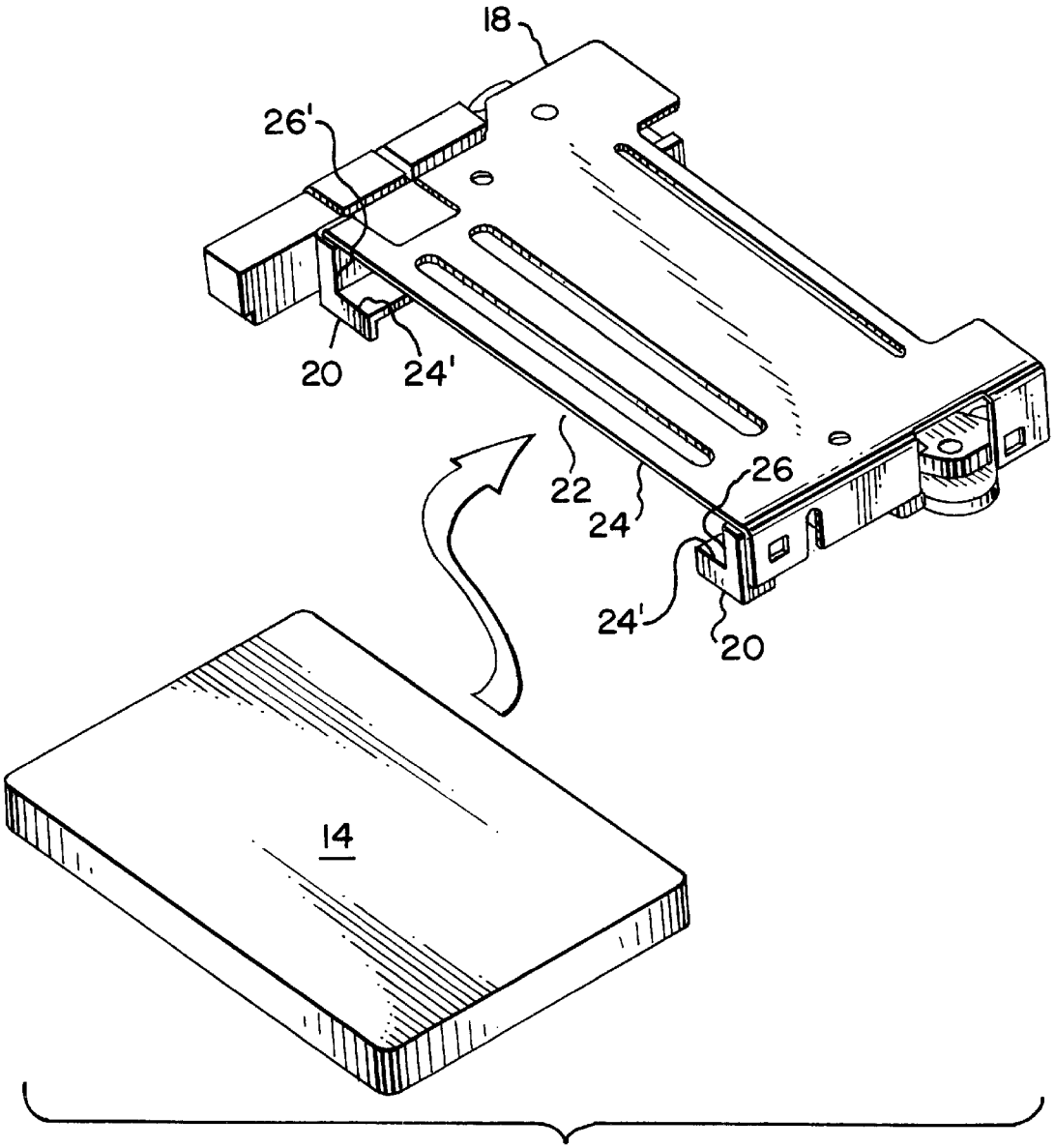
FIG. 2 (PRIOR ART)
FIG. 2 shows a prior art card connector having, a wall defining a slot for receiving a memory card therethrough.
Figure 7:
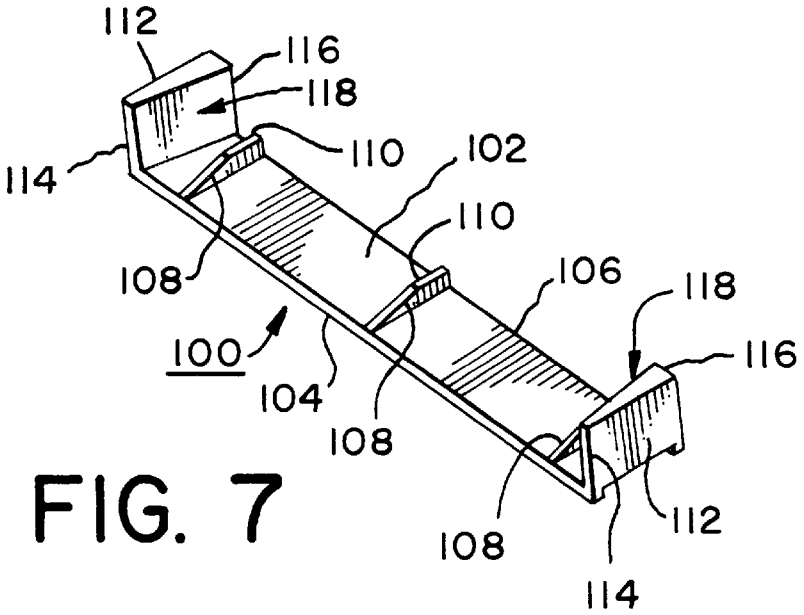
FIG. 7 shows a retro-fit guide member in accordance with the present invention for use with the prior art card connector illustrated in FIG. 2.

A guide portion can be configured as a retro-fit for existing card connectors. FIG. 7 illustrates such a retro-fit guide member 100 for use with commercially available prior art card connector 18 previously illustrated in FIG. 2. As previously described, prior art card connector 18 includes wall 20 having four edges 24,24',26,26' defining slot 22. Retro-fit guide member 100 includes a bottom wall 102 having a front edge 104 and a back edge 106. Bottom wall 102 includes at least one inclined plane 108 disposed adjacent front edge 104, and directed from front edge 104 toward the back edge 106. Bottom wall 102 further includes a planar feature 110 disposed adjacent back edge 106 which is contiguous with inclined plane 108. Back edge 106 is configured to be affixed/mounted in mechanical association with wall 20 of the card connector. Guide member 100 further includes pair of side walls 112, with each side wall having a leading edge 114 and a trailing edge 116. Disposed on each of the side walls is at least one tapered feature 118 disposed adjacent leading edge 114, and directed from leading edge 114 toward trailing edge 116. As illustrated in FIG. 7, tapered feature 118 is an inclined plane (e.g., ramp) having a wedge shape. Trailing edge 116 is configured to be affixed/mounted in mechanical association with the wall of the card connector whereby trailing edge 116 abuts the side edges of the slot.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A memory card compatible device adapted to removably receive a memory card, comprising:

a case having a first portion and a second portion defining an inlet through which the memory card is removably received;

a circuit board housed in the case; and a card connector affixed to a surface of the circuit board and adapted to removably receive the memory card and form an electrical connection between the memory card and the circuit board, the card connector having a top edge, a pair of side edges, and a bottom margin defining a substantially rectangular slot for removably receiving the memory card, the slot being aligned with and spaced from the inlet, the card connector further including a single, unitary guide portion disposed adjacent the slot and having a bottom wall and a pair of side walls, the bottom wall having a first tapered feature directed from a leading edge of the bottom wall toward the bottom margin of the slot, each of the side walls having a second tapered feature directed from a leading edge of the side wall toward one of the pair of side edges of the slot, the first tapered feature being spaced from each of the second tapered features.

2. The device according to claim 1 wherein the first portion includes a guide member having a third tapered feature directed from the inlet toward the slot.

3. The device according to claim 1 wherein the bottom wall is adjacent the circuit board.

* * * * *